US007571580B2

(12) United States Patent
Miller

(10) Patent No.: US 7,571,580 B2
(45) Date of Patent: Aug. 11, 2009

(54) FLOORING

(75) Inventor: Fergus Ronald Miller, Wilmslow (GB)

(73) Assignee: Offshield Limited, Wilmslow (GB)

( * ) Notice: Subject to any disclaimer, the term of this patent is extended or adjusted under 35 U.S.C. 154(b) by 0 days.

(21) Appl. No.: 11/272,379

(22) Filed: Nov. 10, 2005

(65) Prior Publication Data

US 2006/0101761 A1 May 18, 2006

Related U.S. Application Data

(63) Continuation of application No. PCT/GB2004/001949, filed on May 6, 2004.

(30) Foreign Application Priority Data

May 13, 2003 (GB) ..... 0310916.2
Dec. 2, 2003 (GB) ..... 0327976.7

(51) Int. Cl.
*E04B 1/20* (2006.01)

(52) U.S. Cl. ..... 52/650.3; 52/336; 52/220.4

(58) Field of Classification Search ..... 52/650.3, 52/336, 220.4, 450, 448, 223.6, 335
See application file for complete search history.

(56) References Cited

U.S. PATENT DOCUMENTS

| | | | | |
|---|---|---|---|---|
| 910,757 | A * | 1/1909 | Wilson | 52/336 |
| 2,382,139 | A * | 8/1945 | Cueni | 264/228 |
| 3,094,813 | A * | 6/1963 | Van Rensselaer | 52/344 |
| 3,251,167 | A | 5/1966 | Curran | 52/327 |
| 3,513,609 | A * | 5/1970 | Lang | 52/223.6 |
| 3,712,010 | A | 1/1973 | Porter et al. | 52/223 |
| 3,812,636 | A * | 5/1974 | Albrecht et al. | 52/334 |
| 3,956,864 | A * | 5/1976 | Fung | 52/414 |
| 3,967,426 | A * | 7/1976 | Ault et al. | 52/252 |
| 4,453,349 | A * | 6/1984 | Ryan | 52/28 |
| 4,597,233 | A * | 7/1986 | Rongoe, Jr. | 52/334 |
| 4,630,414 | A | 12/1986 | Ting | 52/220 |
| 4,809,474 | A | 3/1989 | Ekberg, Jr. | 52/223 |
| 4,845,908 | A * | 7/1989 | Stohs | 174/486 |
| 5,978,997 | A * | 11/1999 | Grossman | 14/73 |

FOREIGN PATENT DOCUMENTS

| | | |
|---|---|---|
| DE | 1916904 | 10/1970 |
| DE | 2604998 A | 6/1977 |
| GB | 776607 | 6/1957 |
| GB | 2060730 | 5/1981 |
| WO | WO88/01330 | 2/1988 |

* cited by examiner

*Primary Examiner*—Basil Katcheves
(74) *Attorney, Agent, or Firm*—Modern Times Legal; Robert J. Sayre

(57) ABSTRACT

A flooring of pre-stressed deck construction having an elongate decking extending along the flooring is provided. The decking has an upwardly facing asymmetrically profiled channel formation whereby the neutral axis is above a central horizontal plane. A tension rod extends between stressing brackets secured to each end of the decking and is located below the neutral axis of the decking along the length of the decking. Each stressing bracket is secured to upwardly extending sidewalls of the channel above the tension rod. The decking is attached to the girder framework of a building.

13 Claims, 3 Drawing Sheets

FLOORING

CROSS-REFERENCE TO RELATED APPLICATION

This application is a continuation of copending International Application No. PCT/GB2004/001949 filed May 6, 2004 which designates the United States, and claims priority to Great Britain application no. 0310916.2 filed May 13, 2003 and Great Britain application no. 0327976.7 filed Dec. 2, 2003.

FIELD OF THE INVENTION

The present invention relates to flooring, and in particular to flooring of the pre-stressed deck construction.

BACKGROUND

Many buildings, particularly industrial and high-rise buildings are constructed by erecting a steel girder framework with the above-ground floors consisting of steel decking supported by the beams of the girder framework and the decking itself supporting a concrete floor. The floor spans are limited by the bending stresses in the decking due to the weight of the concrete floor, and the deflection of the decking and concrete floor. In order to increase the floor span, it is known to prop the decking at mid-span until the concrete floor has set and reached adequate strength. However, this strength achieving time can be of the order of four weeks, and meanwhile the presence of the props restricts further construction activity. In addition, the props are costly and there is the additional time and cost of fitting and removal. Alternatively, the decking may be supported by means of additional "secondary beams" secured to the beams of the girder framework, but again these are an additional expense. Furthermore, the presence of the secondary beams restricts the passage of services, e.g. gas, water and electricity pipes and cables, through the floor space. As a further alternative, the flooring may be formed of pre-stressed concrete, but this is very costly to produce and transport to the site. In addition, large capacity lifting gear is required to position the flooring.

To avoid or minimize these disadvantages for large floor spans, it is known, for example in U.S. Pat. No. 3,712,010, to introduce an upward camber, and hence a positive bending moment, in the decking prior to pouring the concrete floor thereon. This arrangement is intended to counteract the downward deflection and negative bending moment in the decking due to the weight of the concrete floor, to allow a larger floor span to be used without the stress and deflection limits being exceeded. U.S. Pat. No. 3,712,010 discloses two methods of achieving this initial upward camber and positive bending moment. In the first method, embodied as shown in FIGS. 1 to 8 and 13 to 17, there is a tension rod or tendon extending between the ends of the decking. This tension rod is located in an upwardly facing channel of the decking, which is shaped to be symmetrical about a central horizontal plane, the neutral axis of the decking. The tension rod is secured to brackets attached to the ends, or upwardly bent ends, of the decking, so that it is only at the centre of the span that the tension rod is significantly below the neutral axis of the decking. In consequence, the positive bending moment induced in the decking when the tension rod is tightened will be very small, and the stress in the rod has to be substantial to achieve the desired effect, thereby requiring high-grade steel. Furthermore, since the load induced on the ends of the decking through the brackets or bent ends is wholly or largely on the bottom surface of the decking, there will be a negative bending stress induced at the ends of the decking. This further reduces the positive bending stress induced at the centre of the decking span. There is the additional time consuming and costly operation of welding the tension rod to the centre of the decking in the embodiment of FIGS. 5 to 8 and 13 to 17. In the embodiment shown in FIGS. 9 to 12 the tension rod is located in the downwardly facing channel of the decking. Even in this case the tension rod is attached to the decking above the neutral axis (see FIG. 12 in particular), in order to maximize the inclination of the tension rod, generating some negative bending stresses at the ends of the decking as in the above described embodiments. Furthermore, this embodiment introduces the complexity of the centrally disposed post to form the upward camber in the decking, and effectively requires independently applying tension to both ends of the tension rod. The assembly of the post to the decking is a time consuming and costly operation, and exposes the construction to the risk of fire. In addition, this construction may interfere with the passage of services through the floor space. WO 88/01330 discloses a floor channel and tension rod disposed beneath the neutral axis of the channel. However, the neutral axis of the channel is below the central plane, and this low neutral axis, will cause undesirable higher bending stress in the upper horizontal part and lower stresses in the bottom part of the section.

It is an object of the present invention to provide flooring of pre-stressed deck construction that overcomes, at least to a substantial extent, the disadvantages of the known constructions.

SUMMARY

The invention provides flooring of pre-stressed deck construction comprising an elongate decking having an upwardly facing channel formation extending there along, having a tension rod extending between the ends of the decking and located in the channel below the neutral axis of the decking along the length of the decking, wherein the formation is asymmetrically profiled whereby the neutral axis is above a central horizontal plane.

Preferably, the flooring comprises a stressing bracket secured to each end of the decking, the tension rod being connected to each stressing bracket. Each stressing bracket may be secured to the decking above the tension rod. The stressing brackets may be secured to upwardly extending sidewalls of the channel. The tension rod may extend through a loading bush located in each stressing bracket. Each stressing bracket may be formed of sheet material bent to provide a load face and upper, lower and two opposed side flanges, each flange extending substantially perpendicular to the load face. The loading bush may be located in an aperture in the load face.

Connection means may connect the tension rod to the decking at a mid location there along.

The connection means may be a support clip, which may be of a resilient material. The support clip may be of spring steel. Heat insulation material may be disposed between the tension rod and the decking. The insulation material may be polypropylene, or preferably porous mineral fiber.

The decking may have upper flanges extending laterally of the channel, and the flanges may have interlocking formations extending along their longitudinal edges, whereby a decking may be mutually engaged in side-by-side disposition with an adjacent decking. The decking may have a male formation extending along the edge of one upper flange and a female formation extending along the edge of the other upper flange and adapted to receive a male formation of another decking.

The flooring may comprise a supporting girder framework with the decking being attached to the girder framework. In this case, the stressing bracket may be attached to the girder framework. The girder framework may comprise an I-beam having upper and lower flanges, in which case the stressing bracket may be secured to the upper flange of the I-beam, and may be secured to the underside of the upper flange. The stressing bracket may be secured to the flange of the I-beam by means of screwed studs. The screwed studs may bear on the flange through a countersunk collar. The studs may extend upwardly of the upper flange of the I-beam and into a concrete floor supported by the decking.

The flooring may comprise lateral rods extending transversely of the decking. The lateral rods may be supported above the decking by spacer blocks. The lateral rods may be connected to the decking and may be connected to the interlocking formations of the decking. The lateral rods may be connected to the interlocking formations by means of connecting clips. The connecting clips may be of a resilient material, and may be of spring steel.

The concrete floor may have at least one cavity therein. The cavity may be lined with a waterproof material, which may be a plastics material. The cavity lining may contain water, which may be heated or cooled. The cavity lining may have a plug in an aperture therein, the plug being of a material adapted to melt in the event of a fire in the proximity of the flooring.

BRIEF DESCRIPTION OF THE DRAWINGS

The invention will now be described with reference to the accompanying drawings in which.

DETAILED DESCRIPTION

Figure 1:
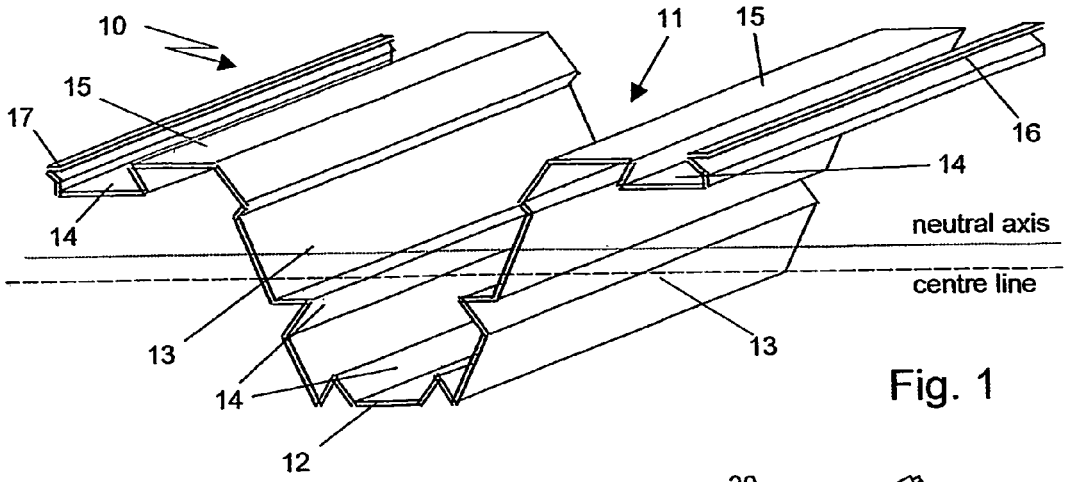
FIG. 1 is a perspective view of a length of decking.
Figure 5:
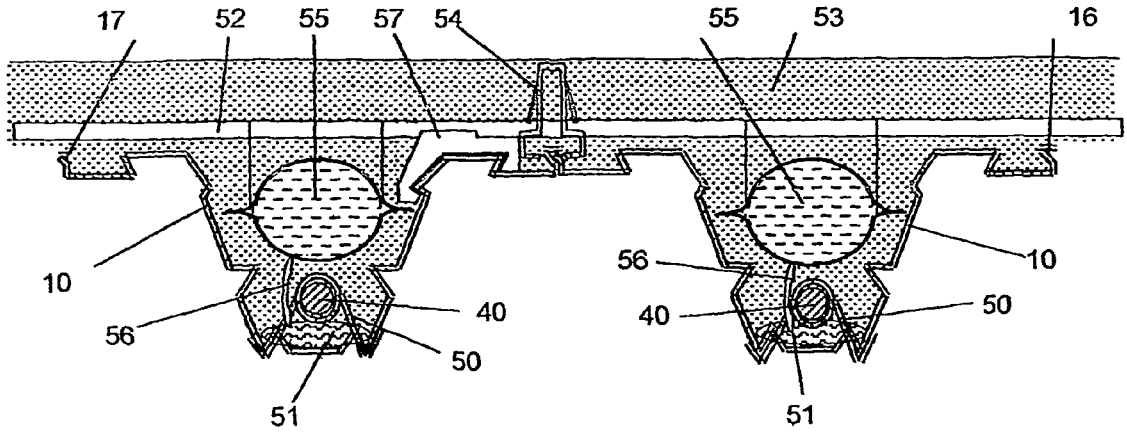
FIG. 5 is a lateral centre-span section through two adjacent deckings.
Figure 6:
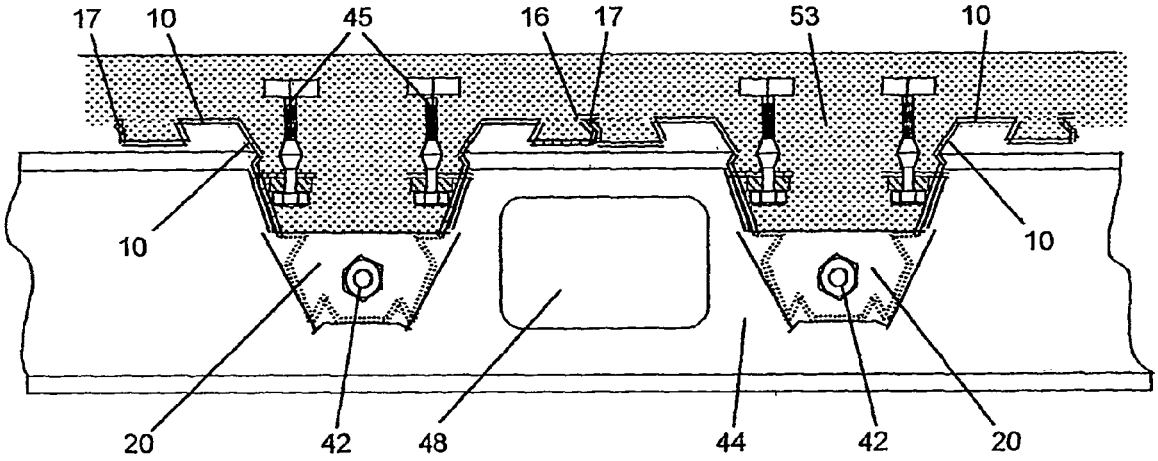
FIG. 6 is an end view of two adjacent deckings.
Figure 7:
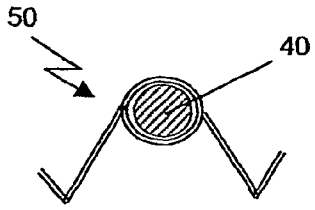
FIG. 7 shows a support clip of FIG. 5 to an enlarged scale.
Figure 8:
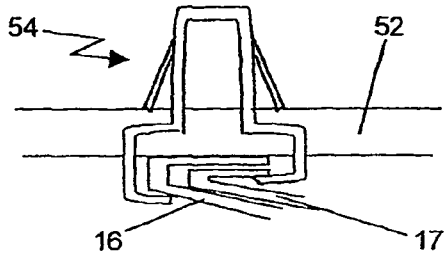
FIG. 8 shows a connecting clip of FIG. 5 to an enlarged scale.

Referring now to FIG. 1, there is shown a length of decking 10. The decking 10 has, in use, an upwardly facing channel 11 formed by a base 12 and sidewalls 13. Ribs 14 are formed by bends in the base 12 and sidewalls 13 for stiffening purposes. In addition, the decking 10 is formed with upper flanges 15 that are also provided with stiffening ribs 14. The channel 11 tapers downwardly, and the upper flanges 15 are considerably larger than the base 12. In consequence of this profile of the decking 10, the neutral axis is as high as is practicably possible above the centre line of the section, as shown. This maximizes the dimension between the neutral axis and the applied tension. One upper flange 15 is formed with a female interlocking formation 16 along its free edge, which is adapted to receive a male interlocking formation 17 formed along the free edge of the other upper flange 15. By this means adjacent deckings 10 may be attached to each other as shown in FIGS. 5 and 6. This construction provides a vertical shear interlock and lateral thrust load transfer between adjacent deckings 10 that assists inter-decking load sharing in either directions.

Figure 2:
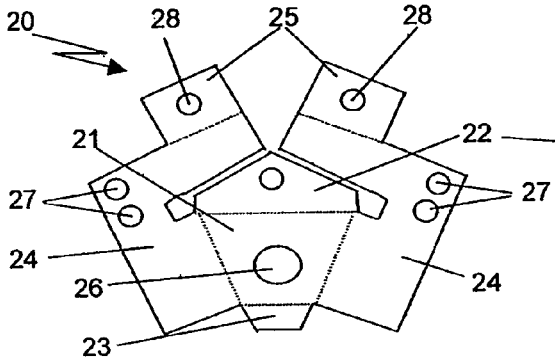
FIGS. 2 and 3 show respectively the development and folded stressing bracket.
Figure 3:
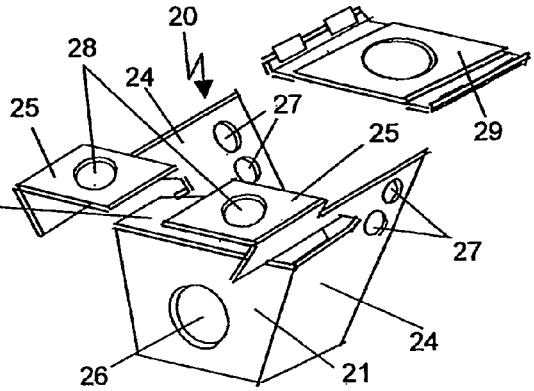

At each end of decking 10 there is provided a stressing bracket 20 as shown in developed and folded configurations in FIGS. 2 and 3. The stressing bracket 20 is formed of sheet material, preferably steel, bent to provide a load face 21 and upper, lower and two opposed side flanges 22, 23, and 24 respectively. When the stressing bracket 20 is bent into shape, each flange 22, 23, 24 extends substantially perpendicular to the load face 21. In addition, side flanges 24 are further bent to form top flanges 25. An aperture 26 is provided in the load face 21, holes 27 are provided in side flanges 24, and holes 28 are provided in top flanges 25 for purposes to be described below. A torsion plate 29 may be provided, for example at mid-span, as a precautionary strengthening of the decking 10. This would abate possible twist distortion during transportation.

Figure 4:
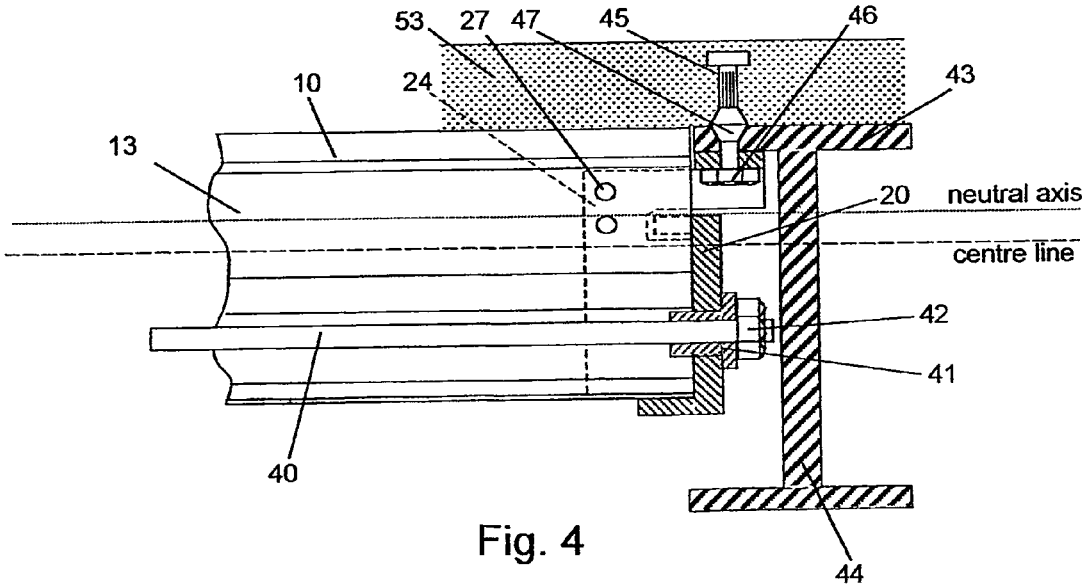
FIG. 4 is a longitudinal section through the end of a decking attached to the girder framework.

Referring now to FIG. 4 there is shown a stressing bracket 20 secured to the end of a decking 10. The side flanges 24 of the stressing bracket 20 are secured by means of bolts or rivets through the holes 27 to the sidewalls 13 of the decking 10. With these bolts or rivets being in a near-vertical sidewall 13 of the decking 10, shear loads from the decking 10 are transferred effectively to the stressing bracket 20. As a more economical alternative for factory prepared units, the stressing bracket 20 may be resistance spot welded. The stressing bracket 20 effectively bears onto a stiffened compression zone at the end of the decking 10 beneath the neutral axis. Pure axial compression stress can be developed in this zone. The end of span shear forces associated with the weight of the decking 10 are taken through the near vertical sidewalls 13 of the decking 10, and transferred via the bolts, rivets or welding to the bracket 20. This arrangement minimizes combined stress effects in the compression zone and the shear sidewalls 13. A tension rod 40 passes through a loading bush 41 located in the aperture 26 in the load face 21 stressing bracket 20. Nut 42 on the end of tension rod 40 is tightened to tension the rod 40 and apply a bending stress to the decking 10. Since the tension rod 40 is below the neutral axis of the decking 10, the bending stress applied to the decking 10 is positive, causing upward arching of the decking 10. Also, since the attachment of the stressing bracket 20 to the decking 10 is above the tension rod 40, there is no negative bending stress applied to the ends of the decking 10. In fact, the positive bending stress applied is enhanced by this configuration.

The stressing bracket 20 is secured to the top flange 43 of an I-beam 44 forming part of the girder framework of the building. For this purpose, shear studs 45 pass through countersunk holes in the top flange 43 and through the holes 28 in top flanges 25 of the stressing bracket 20. A nut 46 on the bottom of the shear stud 45 secures the stressing bracket 20 and the I-beam 44 together. In known constructions, the shear studs are welded to the flange of the girder framework, but this is a time consuming and expensive operation. With the present arrangement, the shear studs 45 bear on the flange 25 through a countersunk collar 47, and assembly of the decking 10 to the girder framework 44 is simplified and less costly than was the case previously. Furthermore, this attachment of the stressing brackets 20 to the I-beams 44 using the shear studs 45 creates a rigid structure providing lateral restraint to the girder 44 to prevent lateral deflection under load.

Figure 9:
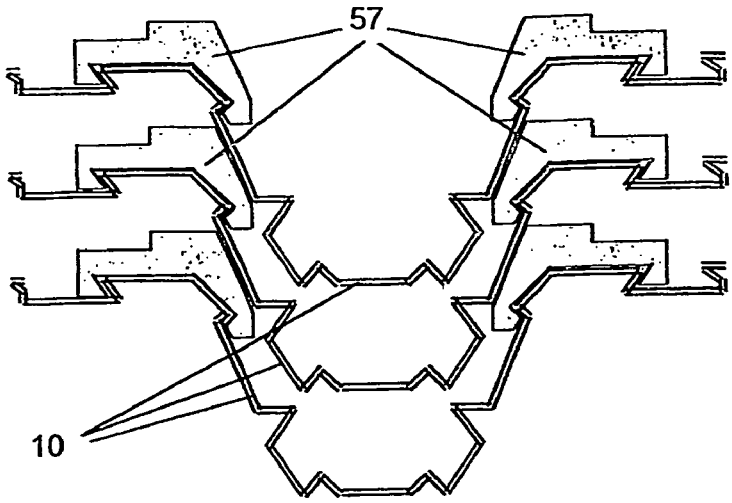
FIG. 9 shows stacked units during transportation.

Referring now to FIGS. 5 to 8, there is shown adjacent deckings 10 attached to each other by means of the male interlocking formation 17 of one decking 10 being received in a female interlocking formation 16 of the adjacent decking 10. At the centre of the span, each tension rod 40 is connected to the decking 10 by means of a spring steel support clip 50. This provides additional central support for the decking 10 to counteract the bending stresses induced in and mid-span deflection of the decking 10 caused by the weight of the concrete floor 53. However, unlike the previously known welding attachment, such attachment does not facilitate the transfer of heat through the floor 53 and tension rod 40 to the decking 10. In addition, heat insulation material 51, for example polypropylene or porous mineral fiber quilting, is disposed between the tension rod 40 and the decking 10 for the purpose of resisting the spread of fire. For the purpose of preventing, or at least minimizing the risk of, shrinkage cracks in the concrete floor 53, lateral rods 52 are located above the decking 10. The lateral rods 52 are connected to the decking 10 at suitable intervals by means of spring steel connecting clips 54. The connecting clips 54 clip to the interlocking formations 16, 17 of the decking 10. By this means, relative longitudinal movement between adjacent deckings 10 is resisted, thereby resisting vertical shear in the concrete floor 53 and providing longitudinal restraint to the girder 44. A services aperture 48 is shown in the girder 44. Lightweight spacer blocks 57 of a plastics material, e.g. dense polystyrene, are provided (only one is shown in FIG. 5) to act as a support for the lateral rods 52. This enables the lateral rods 52 to be located at the optimum height for concrete shrinkage crack control in the floor 53. In addition, the spacer blocks 57 ensure that the lateral rods 42 are not in damaging contact with the decking 10. Use of the spacer blocks 57 as a packing/spacer during transportation of the deckings 10 is shown in FIG. 9.

After such assembly, and after tensioning the tension rods 40 to the required upward deflection and stress in the deckings 10, the concrete floor 53 is poured onto the deckings 10. As the decking 10 is loaded by the concrete flooring 53, the pre-camber introduced into the decking 10 by tensioning of the rod 40 will straighten out, followed by sagging to the permissible centre deflection. This creates an end rotation of the decking 10 that will increase the tension in the tension rod 40 and hence reduction of the negative bending stress on the decking 10 caused by the weight of the concrete flooring 53. The arrangement is partially self-stress relieving. As shown in FIG. 6, from which the I-beam 44 has been removed for clarity, the concrete floor 53 envelops the longitudinally grooved shear studs 45 to resist shear in the floor 53 across the I-beam 44. The countersunk collars 47 reduce the risk of slip between the shear studs 45 and the flange 43. The floor 53 also envelops the lateral rods 52, again to resist shear in the floor 53. To reduce the weight of the floor 53, and therefore the negative bending stresses induced in the decking 10 by the weight of the concrete floor 53, voids 55 are created in the floor 53. The spacer blocks 57 also locate the lateral rods 52 to allow the maximum size of the voids 55, and in themselves form light voids to reduce the weight of the floor 53. The voids 55 are lined with a non-degradable material, for example of a plastics material, and filled with water or other fire preventing fluid, e.g. an inert gas such as carbon dioxide. The lining of voids 53 is suspended from the lateral rods 52. A tube 56 extends from the lined void 55 to the insulation blanket 51. A plug (not shown) of a material that will readily melt in the event of a fire, is disposed in the tube 56 to allow the water or other fluid to escape in the event of a fire. The water or other fluid may be heated or cooled to provide underfloor heating/cooling if desired.

Figure 10:
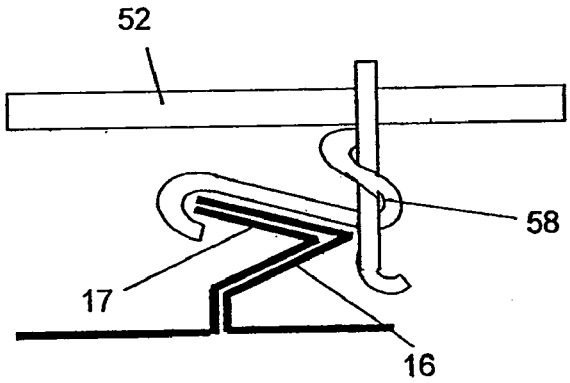
FIGS. 10 and 11 are side and plan views respectively of an alternative support clip.
Figure 11:
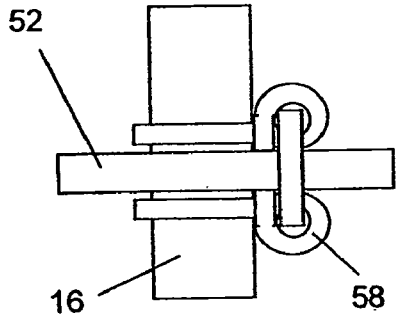

Instead of the connecting clips 54, an alternative form of connecting clip 58 is shown in FIGS. 10 and 11. This clip 58 is preferably of resilient steel wire, and has the advantages that it does not project into the concrete floor 53, it supports the lateral rods 52 at a complimentary level to the spacer blocks 57 and could be of differing sizes to vary the depth of support to the lateral rods 52 for differing ponding depths of concrete floor 53.

By means of the invention, a flooring of pre-stressed deck construction is provided that allows for larger spans than was possible heretofore without exceeding stress and deflection limits. For a given dimensional arrangement, because of lower bending stress levels and centre-span deflection, lower grades of steel for the decking and tension rods can be used, thereby resulting in a cheaper construction. The present construction also provides enhanced lateral stiffness and resistance to shear and lateral deflection, resulting in a more efficient supporting girder through the restraint to the compression flange and reduced tendency to cracking of the concrete floor. In addition, the present construction provides greater resistance to heat transfer through the floor and increased safety in fire situations.

The invention claimed is:

1. Flooring comprising:

a first elongate decking having a single upwardly facing channel defined by a base extending laterally between a first sidewall and a second sidewall, the channel extending longitudinally between two ends of the decking;

a first flange extending laterally outward from a top of the first sidewall and a second flange extending laterally outward from a top of the second sidewall; and longitudinal stiffening ribs formed by bends in the base, first sidewall, second sidewall, first flange, and second flange;

wherein:

said first flange has a longitudinal edge which includes an interlocking formation mutually engaged with a complementary interlocking formation of an adjacent second said decking in a side-by-side disposition with said first decking;

said second flange has a longitudinal edge which includes an interlocking formation mutually engaged with a complementary interlocking formation of an adjacent third said decking in a side-by-side disposition with said first decking;

each of said first, second and third deckings are affixed at each of their ends below a top web of a girder which extends transversely to the deckings;

the flooring comprises biased connecting means for engaging the flanges of said first and second adjacent and connected deckings and said first and third adjacent and connected deckings thereby to bias the first and second deckings and the first and third deckings into mutual engagement; and the flooring further comprises a concrete floor disposed on top of said side-by-side disposed first, second and third deckings and each channel of said first, second and third deckings is associated with a lining that defines a void within the concrete and thereby reduces the weight of the floor.

2. Flooring according to claim 1, wherein for each of said first, second and third deckings the first and second flanges of each said decking have a combined lateral extent that is greater than a lateral extent of the associated base of the decking said first, second and third deckings are each pre-stressed by a respective tensioning rod, each tensioning rod extending between and connected to the ends of a said decking; and each of said first, second and third deckings include a neutral axis defined as a planar region extending longitudinally through each said decking that is neither in compression nor in tension when the flooring is in use, the connection of the tensioning rod with the ends and the location of the tensioning rod along the channel both being entirely below the neutral axis of each said decking.

3. Flooring according to claim 2, comprising an insulation blanket provided between said tensioning rod and said base.

4. Flooring according to claim 2, wherein, each tensioning rod is connected to the ends of a said decking by means of a stressing bracket.

5. Flooring according to claim 4 wherein, for each said decking, the stressing bracket is attached to the decking at a position above the tensioning rod.

6. Flooring according to claim 5 wherein the end of each decking is affixed to the girder by means of the stressing bracket.

7. Flooring according to claim 4 wherein the stressing brackets each bears against the end of the sidewalls of each said channel at a location adjacent the base of the channel that includes stiffening ribs from the base and the sidewalls.

8. Flooring according to claim 1, wherein the first flange on the first decking has a longitudinal edge formed with a female interlocking formation and the second flange on the first decking has a longitudinal edge formed with a male interlocking formation.

9. Flooring according to claim 1, wherein the second flange on the first decking has a longitudinal edge formed with a female interlocking formation and the first flange on the first decking has a longitudinal edge formed with a male interlocking formation.

10. Flooring according to claim 1, wherein said lining is filled with fire preventing fluid.

11. Flooring according to claim 10, wherein said fire preventing fluid is selected from the group consisting of: water, an inert gas or carbon dioxide.

12. Flooring according to claim 11, wherein said lining is suspended from a plurality of lateral rods provided within said concrete and extending transversely with respect to said deckings.

13. Flooring according to claim 1, wherein:

said first, second and third deckings are each pre-stressed by a respective tensioning rod, each tensioning rod extending between and connected to the ends of a said decking;

each said lining is filled with fire preventing fluid;

the flooring further comprises an insulation blanket provided between each of the tensioning rods and the base of each channel;

each said lining comprises a tube extending to said insulation blanket; and each said tube is sealed with a plug of material that is adapted to melt in the event of a fire.

* * * * *